US006709377B1

(12) United States Patent
Rochat

(10) Patent No.: US 6,709,377 B1
(45) Date of Patent: Mar. 23, 2004

(54) SYSTEM AND METHOD FOR QUICK DISCONNECT CENTRIFUGE UNIT

(75) Inventor: Jean-Denis Rochat, Genolier (CH)

(73) Assignee: Haemonetics Corporation, Braintree, MA (US)

( * ) Notice: Subject to any disclaimer, the term of this patent is extended or adjusted under 35 U.S.C. 154(b) by 0 days.

(21) Appl. No.: 09/958,468

(22) PCT Filed: Apr. 7, 2000

(86) PCT No.: PCT/IB00/00436

§ 371 (c)(1),
(2), (4) Date: Mar. 29, 2002

(87) PCT Pub. No.: WO00/61294

PCT Pub. Date: Oct. 19, 2000

(30) Foreign Application Priority Data

Apr. 9, 1999 (EP) ..... 99810294

(51) Int. Cl.[7] ..... B04B 7/00; B04B 13/00
(52) U.S. Cl. ..... 494/2; 494/10; 494/45
(58) Field of Search ..... 494/2, 10, 18, 494/27, 45, 84; 210/380.1, 781, 782

(56) References Cited

U.S. PATENT DOCUMENTS

| | | | | |
|---|---|---|---|---|
| 3,586,413 | A | | 6/1971 | Adams |
| 3,737,096 | A | * | 6/1973 | Jones et al. |
| 4,007,871 | A | | 2/1977 | Jones et al. |
| 4,164,318 | A | * | 8/1979 | Boggs |
| 4,261,507 | A | | 4/1981 | Baumler |
| 4,540,397 | A | * | 9/1985 | Lolachi et al. |
| 5,160,310 | A | * | 11/1992 | Yhland |
| 5,350,514 | A | * | 9/1994 | Witthaus et al. |
| 5,501,840 | A | * | 3/1996 | Mantovani et al. |
| 6,273,849 | B1 | * | 8/2001 | Scherer |

FOREIGN PATENT DOCUMENTS

| | | | |
|---|---|---|---|
| DE | 2833911 | * | 2/1979 |
| EP | 112990 | * | 7/1984 |
| EP | 0 575 858 A2 | | 12/1993 |
| GB | 2063719 | | 10/1983 |
| WO | WO 83/04379 | | 12/1983 |
| WO | WO 88/01907 | | 3/1988 |
| WO | WO 00/61294 | | 10/2000 |

* cited by examiner

*Primary Examiner*—Charles E. Cooley
(74) *Attorney, Agent, or Firm*—Bromberg & Sunstein LLP

(57) ABSTRACT

A centrifugal device. The centrifugal device includes two drive units (1, 22) , coaxially mounted and pivoting, devices (23–33) to drive the first (1) and the second (22) drive units, with a rotational speed ratio of 2/1 between each other, a circular centrifugal unit (2) equipped with at least three channels (4, 5,6) connecting its center to a peripheral separation chamber (3) and three tubes (4*a*, 5*a*, 6*a*) made of an elastic deformable material, each presenting a first extremity connected to the central extremity of one of the three channels (4, 5, 6) of the centrifugal unit (2). The first coupling devices (16) are integral with the first drive unit (1) and the second coupling devices (11) are integral with the centrifugal unit (2), engaged by elastic devices (18). A moving control unit (17), integral with a gripping component (20), is connected to the sad elastic devices (18) to release coupling devices (11, 16) from each other.

25 Claims, 4 Drawing Sheets

SYSTEM AND METHOD FOR QUICK DISCONNECT CENTRIFUGE UNIT

CROSS-REFERENCES TO RELATED APPLICATIONS

This application claims priority from International patent application Ser. No. PCT/IB00/00436, filed Apr. 7, 2000, which further claims priority from European patent application 99810294.1, filed on Apr. 9, 1999.

FIELD OF THE INVENTION

This invention relates to centrifuge systems for the general processing of fluids and, more specifically, a centrifugal device for liquids, such as blood.

BACKGROUND OF THE INVENTION

This invention deals with a centrifugal device for liquids, such as blood, containing suspended particles, comprising a mounted first drive that rotates, a mounted second drive unit that rotates, coaxially to the first drive unit, means to drive the first and the second drive units with a rotation ratio of 2/1 among each other, a centrifugal unit for said liquid, comprising at least three channels that link the center to a peripheral separation chamber, devices to make this centrifugal unit integral with the first drive unit, three tubes made of elastically deformable material, each presenting a first extremity that is integral with the central extremity of one of the three channels of said centrifugal unit with each of these tubes forming an open loop around said centrifugal unit, with the second extremity of this loop being considerably coaxial with the first one and angularly stationary, with one portion of each loop being kinematically integral with the second drive unit, with one of the tubes connected to a supply source of the liquid to be centrifuged, and with the other two used to recover the components with different densities coming from the centrifuging process. This invention also deals with the use of this device.

Such centrifugal devices are well known, such as in the area of blood centrifugation since they permit connecting the centrifuging rotor to the outside to provide a supply of liquid to be centrifuged and to remove the separated components without using an impervious seal. Indeed, from U.S. Pat. No. 3,586,413, it is known that if one has a flexible tube that forms an open loop and for which the two extremities are coaxial, with one being stationary and the other rotating at a speed of $2\omega$ around the common axis to these two extremities, and that the loop is driven at a speed of $\omega$, the flexible tube turns around its own axis at the speed of $-\omega$ thus eliminating the twisting induced by the rotation of the rotor.

In the case of the centrifugation of blood, the separation enclosure must be changed to each donor or to each different patient. Taking into account the centrifugal forces required to obtain the desired separation of the components, the centrifugal rotor must be able to withstand the centrifugal forces to which it is subjected; it must be sized appropriately; it must be balanced to prevent unbalancing and it must be solidly secured to the rotation axis.

Various means have been adopted to meet these requirements: one consists of using a rotor integral with the drive system of the centrifugal device and to arrange positioning devices to receive one or several centrifugal enclosures. Such a solution is described, for instance, in U.S. Pat. No. 4,164,318.

Another solution described in U.S. Pat. No. 4,834,890 consists of arranging a rotor presenting a ring-shaped housing for the purpose of receiving a flexible pouch to be used as separation bag. Installation of the bag in the ring-shaped housing represents an extremely delicate operation. To make this operation easier, it has been proposed in U.S. Pat. No. 4,934,995 to produce the rotor in two parts in between which the housing is located to receive the flexible pouch for the liquid separation.

Another system comprising a rigid rotor for the purpose of receiving a flexible pouch for liquid separation has been proposed in U.S. Pat. No. 4,007,871. U.S. Pat. No. 4,790,807 deals with a rigid but flexible enclosure consisting of a split ring of which the two extremities are separated. To put this enclosure in place in the support rotor, the two extremities of the split ring are brought together and held in place in a rotor housed by its elasticity.

Finally, in U.S. Pat. No. 4,330,080, one has also proposed a rigid disposable rotor in the form of a disk in two parts, one comprised of two ring-shaped chambers for separating the components with different densities and channels to supply the liquid to be centrifuged and to permit evacuation of the components coming from the separation.

The drive shaft of this rotor consists of a tubular component that permits passage of the tubes for the liquid to be centrifuged and the components coming from the separation. The outside of the tube comprises a toothed annular surface for the purpose of engaging with a pinion of the drive mechanism of the device; a first disk with a convex profile is situated on one side of the toothed annular surface and serves to engage three guide pulleys with concave profiles. A second disk, situated on the other side of this toothed annular surface engages with three other guide rollers. Such a drive and guiding mechanism is extremely complex. To remove the disposable rotor, it must be possible to remove one of the rollers associated with each of the guide surfaces, so that these rollers must also be installed on mobile supports that must be locked during the centrifuging operation. As such, it is a system for which exchanging the disposable rotor represents an operation that is not easy or quick to carry out.

Consequently, it can be observed that in this case, there is no unit consisting of a rigid separation enclosure that forms a cup or bowl and its supply and evacuation tubes that permits an easy and quick exchange.

SUMMARY OF THE INVENTION

The purpose of this invention is to remedy, at least in part, the inconveniences of the aforementioned solutions.

In a first embodiment of the invention, there is provided a centrifugal device for liquids, such as blood, containing suspended particles. The device includes a first drive unit that is mounted and pivoting on a pivoting axis. A second drive unit is mounted and pivots coaxially to the first drive unit. Devices drive said first and said second drive units, with a rotational speed ratio of 2:1 between each other. A centrifugal unit for said liquid, having a center, includes at least three channels connecting the center to a peripheral separation chamber. The device further includes at least three tubes. Each tube presents a first extremity integral with a central extremity of a channel respectively of said centrifugal unit. Furthermore, each tube forms an open loop around said centrifugal unit, with a portion of each loop kinematically integral with such second drive unit. One of the tubes is connected to a supply source of said liquid to be centrifuged with at least one other tube used to recover a liquid component. The first coupling devices are integral with the first drive units, while the second coupling devices are integral with the centrifugal unit. Elastic devices are provided to exert an axial force that tends to engage, one with the other, the first and second coupling devices, so as to secure the centrifugal unit to first drive unit.

In a related embodiment of the invention, the first and second coupling devices and the elastic devices are coaxially located to the pivoting axis of the first and second drive units with the ability to be displaced along the pivoting axis against the pressure of the elastic devices.

In another related embodiment of the invention, the first drive unit includes an axial passage and the first coupling devices are a ball ring arranged circumferentially inside the axial passage of said first drive unit.

In still another related embodiment of the invention, one of said tubes linked to a collector of one of the components coming from the centrifugation process includes a proportional valve and detection devices located upstream of the tube to measure the degree of purity of a component that has to flow through said tube. The detector is connected to said proportional valve to regulate the flow in said tube on the basis of the degree of purity measured.

In yet another related embodiment of the invention, one (1) of the units assembled by the coupling devices includes an axial passage to an internal extremity to which a ball ring is coaxially installed. The other (2) of the coupling devices includes a tenon with a diameter that conforms with that of said axial passage and for which the length exceeds that of the passage. Part of the tenon protruding from said axial passage includes a ring-shaped groove sized to receive in part the ball ring and adjacent to a truncated extremity of the tenon. A tubular piston of which one extremity presents a well-formed funnel to receive such ball ring is associated with the elastic devices to press the piston axially in the direction of the extremity of said passage adjacent to said ball ring to apply such ring by exerting on it a centripetal pressure to apply balls in said ring-shaped groove. A gripping device is integral with said tubular piston to permit its displacement against said elastic devices.

In still yet another embodiment of the invention, the first and second coupling devices include a split ring-shaped elastic component coaxially arranged at an internal extremity of an axial passage of the first drive unit of which the cross-section is smaller than the diameter of the elastic component. A tubular piston of which one extremity presents a well-formed funnel receives this component, with said elastic devices pressing axially against this piston in the direction of the internal extremity of said passage to apply a split ring-shaped elastic component by tightening it radially so that its inner diameter is less than that of said passage. A gripping unit is integral with said tubular piston to displace the piston against said elastic devices.

The core of this invention is also the use of this centrifugal device as defined by claim 15.

As such, the device, according to the invention, is of the type for which the circular centrifugal unit forms a single disposable unit, integral with the tubes that supply and remove the liquids. Securing of the circular centrifugal unit to its drive unit is achieved by manual snapping into place. The securing system is not subject to the centrifugal forces since it operates axially. Once connected, there is no risk of unforeseen separation. Disconnection of the centrifugal unit only requires simple axial traction against the elastic pressure of the retaining spring. No mechanical component other than the second coupling component is located on the centrifugal unit, so that the latter is a simple part that can be manufactured cheaply. The simplicity and speed of the operations for exchanging the centrifugal unit, as well as its price, thus permit achieving a substantial gain with regard to the price of the equipment, and the cost of centrifugation. This savings is extremely important, particularly when the device according to the invention is used for collecting plasma.

BRIEF DESCRIPTION OF THE DRAWINGS

The invention will be better understood when reading the following description of a form of execution and of a variant of the liquid centrifugal device according to this invention, schematically illustrated as an example by the attached drawing on which.

DETAILED DESCRIPTION OF SPECIFIC EMBODIMENTS

Figure 1:
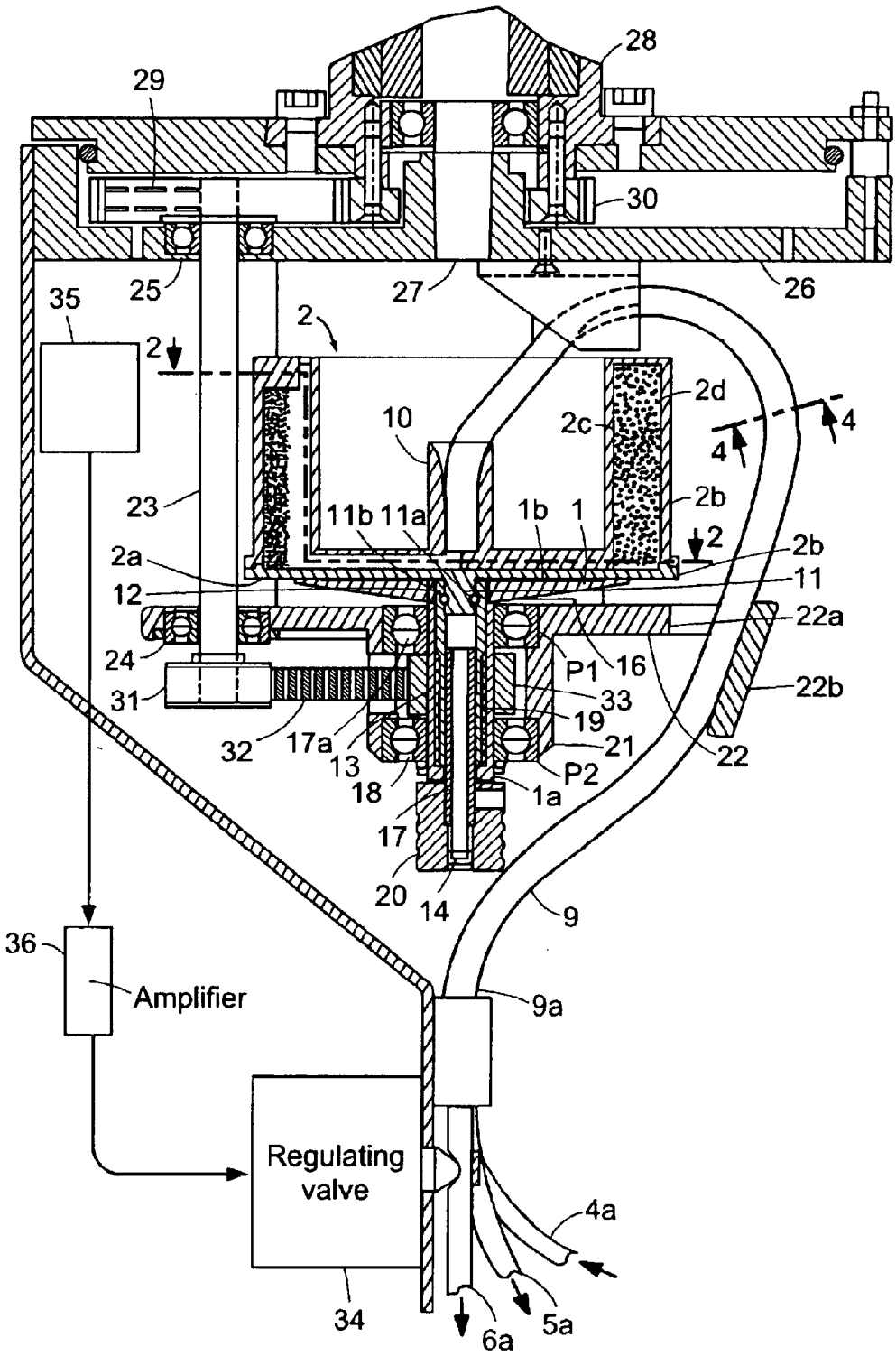
FIG. 1 is a sectional view of an elevation of this form of execution.
Figure 2:
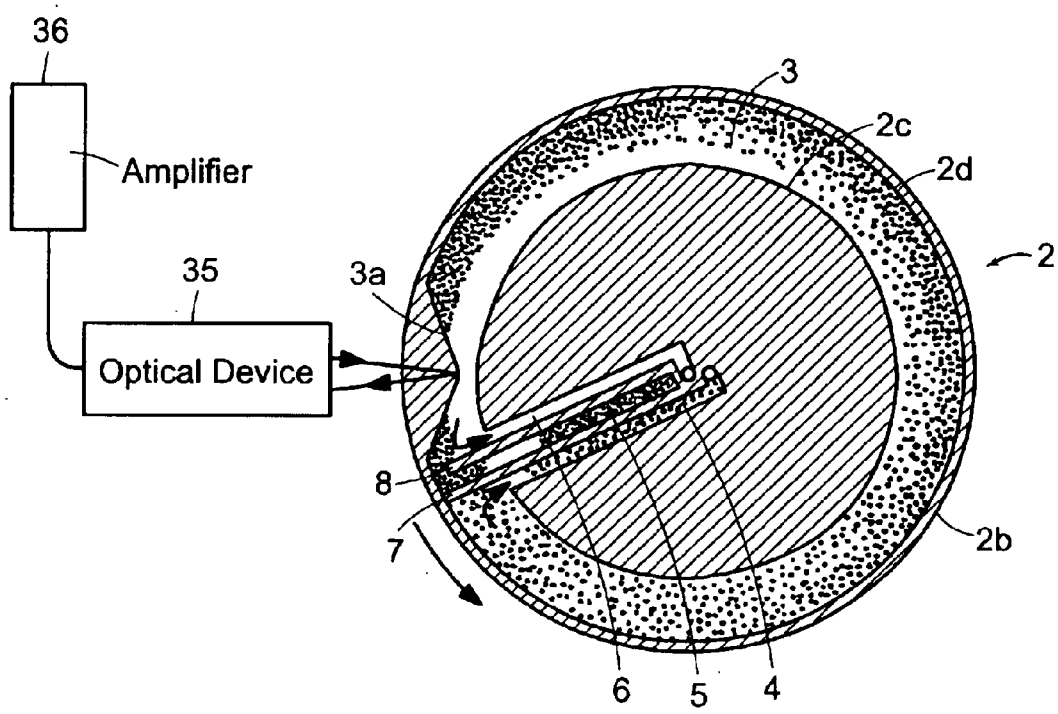
FIG. 2 is a partial sectional view, according to line II—II of FIG. 1.

The centrifugal device illustrated by FIG. 1, used among other things, for plasmapheresis, includes a centrifugal rotor that has the form of a disk 1 arranged at the end of a tubular body 1*a*, mounted and rotating in two ball bearings P1, P2. This centrifugal rotor 1 carries a disposable centrifugation cup or bowl 2, itself formed by joining two parts through welding or gluing, one at the bottom, formed by a disk 2*a* and the other on top 2*b*, showing two cylindrical and concentric side walls, one inside 2*c* and the other outside 2*d*, between which a ring-shaped separation enclosure 3 (FIGS. 1 and 2) is installed. Three radial channels 4, 5, 6 installed in the top portion 2*b* of the centrifugal cup or bowl 2, connect this ring-shaped separation enclosure 3 to the center of this cup or bowl 2. Channel 4 is the supply channel of the blood to be centrifuged. It has a partition 7 that joins side wall 2*d* of ring-shaped separation enclosure 3, while the other wall of this supply channel 4 ends at internal side wall 2*c* of this separation enclosure 3.

Partition 7 also serves to separate channel 4 from channel 5, used for recovering the blood cells, for which the other partition 8 ends at a certain distance of external side wall 2*d* of ring-shaped separation enclosure 3. This partition 8 thus separates channels 5 and 6 and makes them communicate, respectively, with the external portion of ring-shaped separation enclosure 3, in other words, the one where the blood cells are concentrated, from the one with the smallest density where the plasma is concentrated. Obviously, a subsequent separation of recovered blood cells is possible to separate the erythrocytes, the leukocytes and the platelets. For a variant of cup or bowl 2, one might also envisage having more than two outlet channels to obtain this separation.

Figure 4:
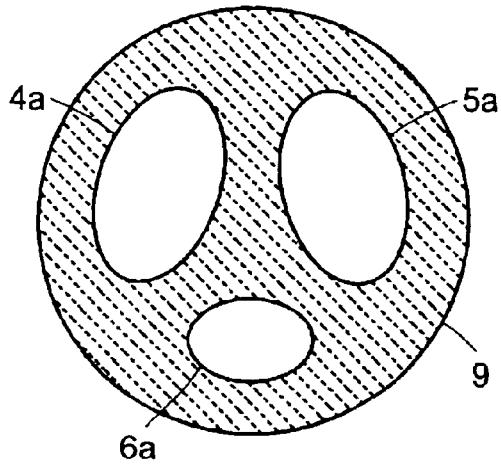
FIG. 4 is an enlarged sectional view according to line IV—IV of FIG. 1.

These three channels, 4, 5, and 6, end at the center of cup or bowl 2 where they are connected to three tubes 4*a*, 5*a* and 6*a* respectively (FIG. 4) that are, preferably, arranged in parallel in one and the same flexible tubular component 9. The portion of this tubular component 9, adjacent to its extremity connected to channels 4, 5, and 6, is held in a tubular housing 10 formed coaxially with the rotating axis of cup or bowl 2, on top portion 2*b* thereof. The sections of the three tubes 4*a*, 5*a* and 6*a* are elliptical, with the large centerlines of these ellipses tangential to at least one concentric circle with the longitudinal axis of tubular component 9. This orientation of the elliptical sections of tubes 4*a*, 5*a*, and 6*a* facilitates the rotation of the tubular component around its longitudinal axis.

From the foregoing, the result is that the mobile part is to be discarded after each use, only consisting of three parts, cup or bowl 2, consisting of two parts 2*a*, 2*b* welded or glued together, and tubular component 9 Moreover, this unit does not require any impervious seal. This unit is connected to, but can be removed from, the centrifugal rotor 1 in the manner described below.

The bottom of the disk that forms bottom part 2*a* of cup or bowl 2 carries a coupling element consisting of a cylindrical rod or tenon 11, comprising a semicircular groove 11*a*, adjacent to a truncated end 11*b*. This coupling rod 11 is engaged in a coupling element consisting of a ring 12, a coupling mechanism 13, with this ring and this coupling mechanism housed in the tubular portion 1*a* of rotor 1.

Coupling mechanism 13 includes a coupling device that, in this form of execution, consists of a ball ring 16 that is located at the inside end of the axial passage formed by ring 12 that is integral with tubular part 1*a* of rotor 1. A tubular piston 18 is mounted and sliding inside tubular part 1*a*. Its top extremity ends in a surface that has the form of a funnel 17*a*. This tubular piston 18 is pressed axially against the internal extremity of ring 12 by a helicoidal spring 18 compressed between one end of tubular part 1*a* of rotor 1 and a bearing surface of tubular piston 17. This axial pressure in the direction of ring 12 and funnel form 17*a* have the effect of exercising centripetal forces on ball ring 16 that press them into groove 11*a* of coupling rod 11 of cup or bowl 2.

To prevent these balls from engaging in the axial opening of ring 12, during the removal of coupling rod 11, a second piston 14 is mounted and slid inside tubular piston 17 and a second helicoidal spring 19 pushes it axially against the end of coupling unit 11.

According to a variant, ball ring 16 could be replaced by a split ting-shaped piano wire type spring, or else by a coil spring that forms a toric spring, for which both extremities would then be brought together by funnel 17*a* under the pressure of helicoidal spring 18, thus reducing its diameter to keep it engaged in groove 11*a* of the coupling rod.

The external extremity of tubular piston 17 is integral with an grasping component 20 to permit an axial traction against the pressure of spring 18, to enable balls 16 to move toward the outside. Piston 14 subjected to the axial pressure of spring 19 can then eject cup or bowl 2 upward and keep balls 16 removed at the same time.

As we can see on FIG. 1, to ensure a proper tightness of cup or bowl 2 on rotor 1, the top surface of the disk carrying this cup or bowl 2 shows a slight clearance 1*b*, that ensures good contact with the peripheral ring-shaped surface of this disk. Moreover, the axial position of groove 11*a* of the coupling rod 11 can be selected to find itself still partially in the axial passage of ring 12 so that the engagement of balls 16 in this groove 11*a* may induce a very slight sagging of the center at the bottom of cup or bowl 2 that permits the removal 1*b* of the disk of rotor 1, thus ensuring an adequate contact between this disk and cup or bowl 2 to ensure that the latter is being driven by friction. In the event that this friction is inadequate, radial grooves could be provided to prevent the sliding of cup or bowl 2 with respect to the disk of rotor 1.

Figure 3:
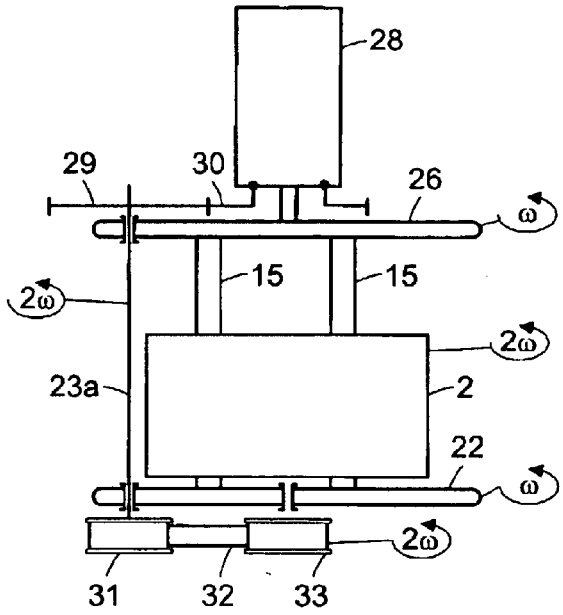
FIG. 3 is a schematic view of the kinematics of the drive mechanism.

Ball bearings P1, P2 of the tubular portion of the rotor are mounted in a support 21 secured to a tray 22, itself secured to a top disk 26 by four uprights 15, two of which are located behind cup or bowl 2 and which are visible on FIGS. 1 and 3; the other two are arranged symmetrically with respect to a drive shaft 23 parallel to the axis of rotor 1. Thanks to this arrangement, the side of the centrifugal device opposite to the drive shaft is free, enabling the lateral insertion of cup or bowl 2 and the installation of tubular component 9. This permits easy access to centrifugation cup or bowl 2 and its easy installation and removal.

Drive shaft 23 is mounted to pivot by means of two ball bearings 24, 25 respectively, integral to tray 22 and to top disk 26 located above cup or bowl 2. This top disk 26 is integral to drive shaft 27 of motor 28, coaxial to the rotating axis of rotor 1. The extremity of shaft 23 that extends above disk 26 is integral with a satellite pinion 29 engaged with a stationary pinion 30. The ratio between the diameters of satellite pinion 29 and of stationary pinion 30 is 1/1 so that if the rotation speed of tray 26 is $\omega$, that of shaft 23 around its axis is $2\omega$. The bottom extremity of this shaft 23 carries a notched pinion 31 connected by a notched belt 32 to a notched pinion 33, of the same diameter as notched pinion 31, so that rotor 1 is driven at speed $2\omega$.

Flexible tubular component 9 forms an open loop of which one extremity 9*a* is stationary and coaxial with the pivoting axis of rotor 1. This extremity 9*a* is fixed and held in a tubular connecting housing 10' similar to housing 10 that supports the other extremity of this tubular component 9. Each of these tubular components 10 and 10' shows a type of funnel 10*a* and 10'*a* respectively (FIG. 5) that provides support to this portion of tubular component 9 when it is subjected to the centrifugal force. This loop passes through an opening 22*a* in tray 22, so that it is driven around the pivoting axis of rotor 1 at speed $\omega$, while its extremity attached to the center of cup or bowl 2 is driven at speed $2\omega$ and while the other extremity 9*a* is stationary, so that the flexible component is driven between these two extremities at the speed $-\omega$ around its longitudinal axis while eliminating any torsion accumulation between these two extremities. This principle is well known since U.S. Pat. No. 3,586,413 by Adams. A support surface 22*b* integral with tray 22 serves to limit the deformation of tubular component 9 under the effect of the centrifugal force. The guiding parts of tubular component 9 are preferably made of a self-lubricating material or one with a slow friction coefficient, such as Oilamid®, bronze Teflon® or Valflon®.

Downstream of stationary component 9*a* of tubular component 9, the three tubes 4*a*, 5*a* and 6*a* separate and plasma tube 6*a* is connected to a flow regulating valve 34 according to the position of the surface of separation between the plasma and the blood cells in separation enclosure 3.

For that purpose, a double prism 3*a* is installed at the top extremity of separation enclosure 3 and consists of one piece with top part 2*b* of cup or bowl 2 during its injection. The portion of this double prism 3*a* that is covered with blood cells separated from the blood by the centrifugal force as a result of rotating cup or bowl 2 is opaque, while the part that emerges from the plasma is transparent. An optical device 35 comprising a laser and a photoelectric detector is installed with respect to this prism 3*a*, so that the photoelectric detector receives light reflected by the part of the double prism 3*a* that emerges from the transparent plasma. With each turn of cup or bowl 2, a signal of a duration proportional to the angular value of the transparent zone of the double prism 3*a* is thus provided to an amplifier 36 for which the output is connected to proportional valve 34. According to the fact that this transparent zone increases or diminishes, amplifier 36 shall control proportional valve 34 so that it reduces or increases the section of tube 6*a* that evacuates the plasma, permitting it to maintain through this adjustment, the balance between the flows in the outgoing tubes 5*a* and 6*a*, this on the basis of an incoming flow determined by the pump supplying blood in tube 4*a*, itself determined by the vein pressure in the donor's arm.

Sizing of centrifugation cup or bowl 2 and of tubular component 9 forming the open loop is selected to permit reducing the overall dimension, weight, price and volume for this cup or bowl 2 as for the whole centrifugal device for which sizing is essentially dependent on the diameter of the centrifugation cup or bowl. If the diameter diminishes, speed must be increased. The speed increase can be limited by increasing the height of the centrifuge enclosure 3, so that the maximum flow remains practically constant, the latter being determined by obtaining a good sedimentation of the blood cells.

As an example, the diameter of the cup or bowl is 80 mm and its height is considerably equal to its radius. Such a diameter corresponds approximately to one third of that of the state-of-the-art separation rotors. Consequently, the length of the open loop formed by tube 9 corresponds considerably to one-third of the loops provided by the state of the art.

By reducing the radius of cup or bowl 2 and thus the length of the loop formed by tube 9, the traction force exerted on it by the centrifugal force to which it is subjected can be maintained at a constant value. Instead of using three tubes of 4 mm in diameter, we have a single tube 9 of 7 mm in diameter, so that the resulting cross-sectional surface area is the same, namely 0.38 $cm^2$. The material of this tube is plastified PVC or silicone with a specific weight of 1.2 $g/cm^3$, as for the state of the art. Since the length of the open loop of tubular component 9 is reduced to one-third of that of the state of the art, the weight of this tubular component thus also corresponds considerably to one-third. Also, the radius of the open loop is practically reduced to one-third.

Traction force F exerted on this tube is equal to:

$$F=m\omega^2.R$$

For the state-of-the-art, one obtains at a loop speed of 1000 rpm (ω100), equal to half the rotor speed that is 2000 rpm and with a loop radius of 0.13 m, a force of:

$$F=0.014.100^2.0.13=18.2\ \text{N}$$

In the case of this example according to this invention, with a weight of 0.0046 kg, a loop speed of 3000 rpm (equal to the speed of rotor 1 of 6000 rpm) and a loop radius of 0.045 m, the force is:

$$F=0.0046.300^2.0{,}045=18.6\ \text{N}$$

The value of the traction efforts is:

$$\sigma=F/S=18/38=0.47\ \text{N/mm}^2$$

Since the value of the alternating bending stresses on the tubular component is:

$$\sigma=E.r/R$$

where r=the radius of the tubular component and R, the radius of the loop formed by this tubular component Since radius R is smaller in the case of this invention, in order to reduce σ, also r and E must be reduced. In the example given, E=4 $N/mm^2$ and $\sigma_{breaking}$=12 $N/mm^2$. In the case of bending stresses equal to 1 million alternated bends, or 5½ hours of operation, this value is reduced by a factor of 5 to take into account additional fatigue, so that $\sigma_{breaking}$, for an alternated bending stress of 2.4 $N/mm^2$ $$\sigma=4.3{,}5/30=0.47\ \text{N/mm}^2$$

being a safety factor of 2.4/0.47=5

This example of sizing shows that it is quite possible to reduce very considerably the diameter of the separation enclosure without losing performance and without increasing streses, provided certain measures are taken for that purpose. However, this reduction in diameter permits reducing the size of the device in a very considerable way. This permits having a much more compact device, that is lighter and less costly to manufacture. Since this device takes up little space, a greater number of devices can be installed on one and the same surface which is important, such as in the case of trucks used for collecting plasma where space is limited.

As an example, the rotating part, according to the invention, weighs 600 g while the rotors of the devices according to the state-of-the-art weigh almost five times as much. That is the reason why plasmapheresis is generally not conducted for collecting blood at the spot, but blood is collected in flexible pouches that are then placed in very large centrifuges. In this case, erythrocytes can no longer be returned to the blood donor. However, the time required for the body to reproduce the quantity of erythrocytes is long, which explains why several months are necessarily required in between two sessions of giving blood by the same donor, which would not be required if the erythrocytes could have been reinjected after separation. However, this is possible only if separation takes place simultaneously while the blood is taken.

There are other types of machines that operate with a single usage centrifugation bowl, but these require a rotating joint, leading to a more expensive solution that does not permit the simultaneous supply of the liquid to be centrifuged and the evacuation of the separated components, so that it is necessary to alternate the supply and the evacuation, resulting in a large extra-corporal volume.

The importance of having light and small centrifugal devices, and above all, disposable separation enclosures that can be produced cheaply, is consequently obvious. The ease of exchanging these enclosures or separation cups is also a requirement. Only when all of these conditions exist can the replacement of the present methods used for collecting plasma be possible.

Another important aspect of this invention can be found in the fact that the complete liquid circulation is obtained by the overpressure with which the blood is brought into centrifugal cup or bowl 2. This overpressure must compensate the load losses induced in supply tube 4*a* as well as in the recovery tubes of blood cells 5*a* and plasma 6*a* To create such an overpressure, one can use a peristaltic pump for the purpose of ensuring the desired flow rate downstream of the separation. No peristaltic intake pump of outgoing components is, therefore, necessary since regulation of the plasma flow is obtained by regulating valve 34 controlled by its automatic control system on the basis of the position variation of the border between plasma and blood cells.

It is well understood that if this device is particularly appropriate for use in conducting plasmapheresis in line with the taking of blood, it can of course also be used in therapeutic applications. Indeed, one can observe that tubular component 9, containing the three tubes 4*a*, 5*a* and 6*a*, is calculated with a safety factor of 5 for continuous use exceeding 5 hours, which permits its use in all applications considered.

The device covered by this invention can also be used for cleaning blood cells by introducing alternatively, the proper equipment known in this field, the cells to be washed and a cleansing fluid. As a variant, the cleansing fluid could be introduced through an additional tube, thus permitting the simultaneous separation and cleaning. In this case, tubular component 9 shall then include four tubes instead of the three shown.

Figure 5:
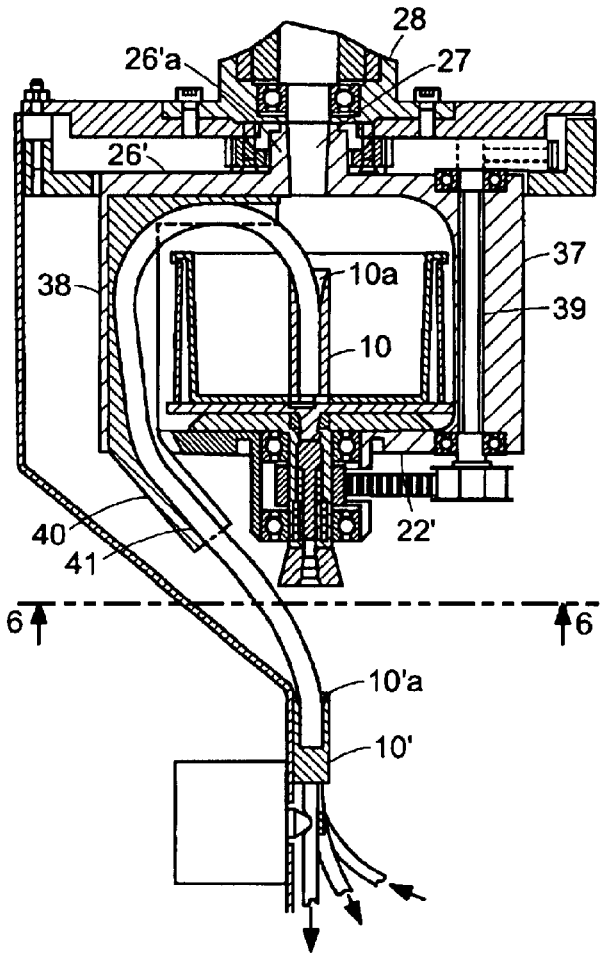
FIG. 5 is a partial sectional view of a variant of the form of execution of FIG. 1.
Figure 6:
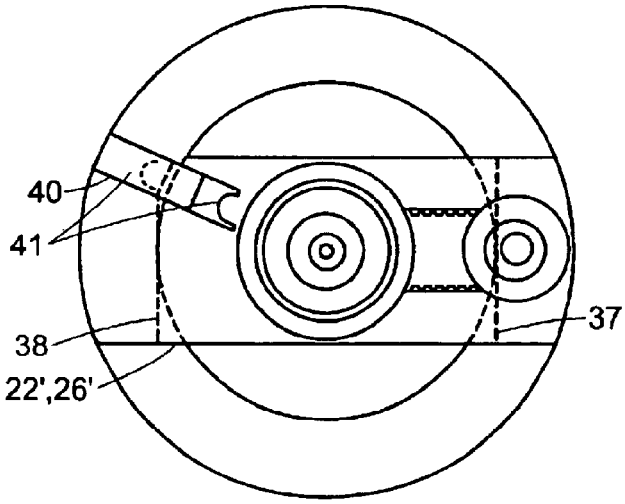
FIG. 6 is a view according to line VI—VI of FIG. 5.

For the variant illustrated by FIGS. 5 and 6, the two disks 22 and 26 of the previous form of execution are replaced by two diametrical arms 22', 26' that are made of a single aluminum piece with two diametrically opposite pillars 37 and 38. Arm 26' shows a hub 26'*a* that is pressed onto shaft 27 of motor 28. Pillar 37 shows a cylindrical passage 39 for the passage of drive shaft 23. The other pillar 38 is integral to a support 40 that has a guiding groove 41 of the tubular component 9.

Support 40 is designed to support flexible tubular component 9 in the area where its radius is the greatest, in other words, where the centrifugal force is the greatest. Funnel 10*a* supports the central part of tubular component 9.

To reduce friction between groove 41 of support 40 and tubular component 9 during the rotation of the device, support 40 is made, like support 22*b* in the form of execution of FIG. 1, of a material with a low friction coefficient. Besides the materials already mentioned, a polyethylene with high molecular weight (PEHMW) could be used. Sliding can also be improved by use during the manufacture of tubular component 9, when the latter is made of PVC, a silicon-based plastifying agent which makes its surface slide better. Friction can also be reduced by reducing the contact surface of groove 41 by streaks, possibly in the form of corkscrews.

Figure 7:
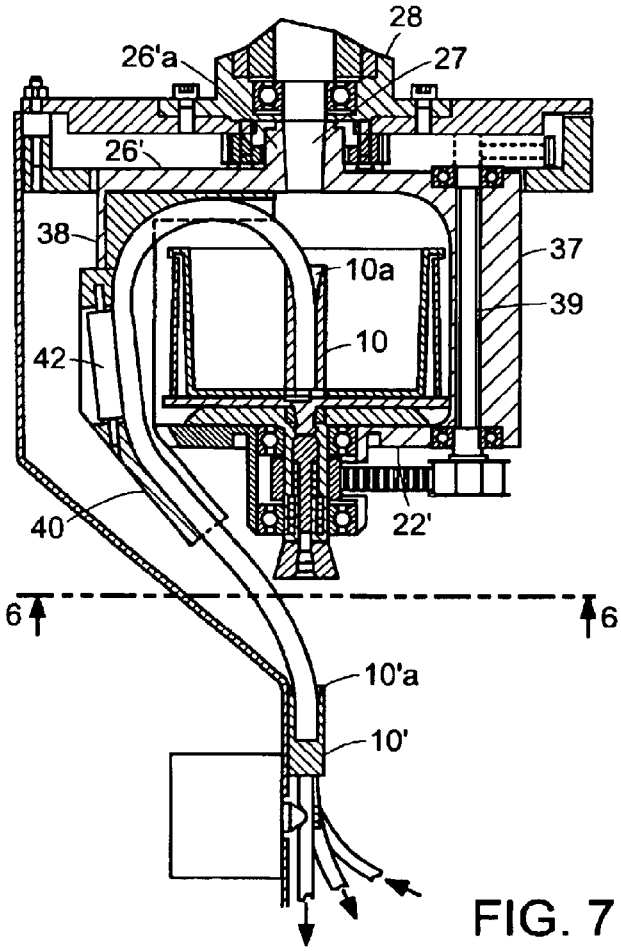
FIG. 7 is a similar view of FIGS. 1 and 5 of another variant.

According to a last variant illustrated by FIG. 7, in the groove of support 40 there are rollers 42 turning freely around axes that are parallel to that of tubular component 9. These rollers 42 are driven by the rotation of tubular component 9 on itself.

The rest of the centrifugal device coincides with the form of execution described before. The variant described in relation to FIGS. 5 and 6 facilitates the balance and permits increasing the safety of the device when it rotates at centrifugal speed. It also improves guidance and support of tubular component 9, which is as such subjected to minimally the centrifugal force.

What is claimed is:

1. A centrifugal device for liquids, such as blood, containing suspended particles, comprising:

a first drive unit that is mounted and pivoting on a pivoting axis;

a second drive unit that is mounted and pivoting coaxially to the first drive unit;

devices to drive said first and said second drive units, with a rotational speed ratio of 2:1 between each other;

a centrifugal unit for said liquid having a center, comprising at least three channels connecting the center to a peripheral separation chamber; and at least three tubes, each presenting a first extremity integral with a central extremity of a channel respectively of said centrifugal unit, with each tube forming an open loop around said centrifugal unit, with a portion of each loop kinematically integral with such second drive unit, with one of said tubes being connected to a supply source of said liquid to be centrifuged with at least one other used to recover a liquid component wherein:

first coupling devices are integral with said first drive units;

second coupling devices, said separation chamber and said channels are integral with said centrifugal unit;

elastic devices are provided to exert an axial force that tends to engage, one with the other, said first and second coupling devices, so as to secure said centrifugal unit to first drive unit and said first and second coupling devices and said elastic devices are coaxially located to the pivoting axis of said first and second drive units with the ability to be displaced along said pivoting axis against the pressure of said elastic devices.

2. A device according to claim 1, further comprising a moving control unit connected to said elastic devices so that the movement of the control unit opposed to the force exerted by the elastic devices permits releasing said coupling devices one from the other.

3. A device according to claim 1, wherein said elastic devices drive a moving piston engaged with the first coupling devices causing contact of the first and second coupling devices.

4. A device according to claim 1, wherein said second coupling devices exert on said elastic devices a greater force and in a direction contrary to the axial force that tends to engage said first and second coupling devices with the other during the installation of said centrifugal unit on said first drive unit.

5. A device according to claim 1, wherein a space is provided laterally to said first and second drive units to permit the centrifugal unit to pass.

6. A device according to claim 1, wherein the centrifugal unit comprises two parts assembled tightly one to the other such that said three tubes form a single tubular component in which three separate tubes are located with one extremity of the tubular component installed imperviously and coaxially to the rotation axis of said centrifugal unit.

7. A device, according to claim 6, wherein the parts of the device in contact with said tubular component are made of a self-lubricating material or of a material with a low friction coefficient.

8. A device, according to claim 1, wherein the device comprises a fourth tube of which two are connected, respectively, to pressurized sources of erythrocytes and another to a pressurized source of cleansing fluid for the erythrocytes.

9. A device, according to claim 1, wherein one of said tubes is alternately connected to a pressurized source of erythrocytes and to a pressurized source of cleansing fluid for the erythrocytes.

10. A device, according to claim 1, wherein said second drive unit and a component integral with devices to drive the second drive unit form a single part.

11. A device, according to claim 1, wherein radial grooves to increase the friction force are provided in at least one of the surfaces in contact with said first drive unit and said centrifugal unit.

12. Use of a centrifugal unit according to claim 1, wherein the liquid to be centrifuged is placed under a selected pressure to overcome load losses and to ensure a desired flow rate of said liquid.

13. A centrifugal device for liquids, such as blood, containing suspended particles, comprising:

a first drive unit that is mounted and pivoting;

a second drive unit that is mounted and pivoting coaxially to the first drive devices to drive said first and said second drive units, with a rotational speed ratio of 2:1 between each other;

a centrifugal unit for said liquid having a center, comprising at least three channels connecting the center to a peripheral separation chamber; and at least three tubes, each presenting a first extremity integral with a central extremity of a channel respectively of said centrifugal unit, with each tube forming an open loop around said centrifugal unit, with a portion of each loop kinematically integral with such second drive unit, with one of said tubes being connected to a supply source of said liquid to be centrifuged with at least one other used to recover a liquid component wherein:

first coupling devices are integral with said first drive unit;

second coupling devices are integral with said centrifugal unit;

elastic devices are provided to exert an axial force that tends to engage, one with the other, said first and second coupling devices, so as to secure said centrifugal unit to first drive unit; and the first drive unit includes an axial passage and the first coupling devices are a ball ring arranged circumferentially inside the axial passage of said first drive unit.

14. A device according to claim 13, wherein the second of the coupling devices comprise a truncated extremity to temporarily move said ball ring in a general radial direction when the second coupling devices are inserted in the axial passage.

15. A device according to claim 13, wherein the centrifugal unit includes a bottom part and the second coupling devices consist of a rod mounted on the bottom part of the centrifugal unit, with the rod presenting a circumferential groove sized to receive a portion of said ball ring when the centrifugal unit is mounted on the first drive unit.

16. A device according to claim 15, further comprising a first moving piston coupled to said elastic devices so that the movement of said first piston in a direction opposite to the force exerted by said elastic devices permits separating of the first coupling devices from the second coupling devices.

17. A device according to claim 16, wherein the first piston has a surface in the form of a funnel so that following the axial force of said elastic devices the first piston subjects said ball ring to a centripetal force, thus securing the centrifugal unit to the first drive unit.

18. A device according to claim 17, further comprising a gripping component integral with said first piston to permit moving the first piston against said elastic devices thus separating the funnel surface of the first piston from the ball ring, releasing the ball ring from the centripetal force.

19. A device according to claim 18, wherein:

a second piston is mounted and sliding inside said first piston;

the second elastic devices are pushing the second piston in the direction of an internal extremity of said axial passage; and the stroke of the second piston having been selected to make the piston penetrate in said axial passage during the separation of said centrifugal unit from the first drive unit and to retain said ball ring in said funnel of said first piston.

20. A device according to claim 19, wherein the pressure exerted on the second piston by said second elastic devices is capable of ejecting said centrifugal unit during the separation of said first and second coupling devices.

21. A centrifugal device for liquids, such as blood, containing suspended particles, comprising:

a first drive unit that is mounted and pivoting; a second drive unit that is mounted and pivoting coaxially to the first drive unit;

devices to drive said first and said second drive units, with a rotational speed ratio of 2:1 between each other;

a centrifugal unit for said liquid having a center, comprising at least three channels connecting the center to a peripheral separation chamber; and at least three tubes, each presenting a first extremity integral with a central extremity of a channel respectively of said centrifugal unit, with each tube forming an open loop around said centrifugal unit, with a portion of each loop kinematically integral with such second drive unit, with one of said tubes being connected to a supply source of said liquid to be centrifuged with at least one other used to recover a liquid component wherein:

first coupling devices are integral with said first drive unit;

second coupling devices are integral with said centrifugal unit;

elastic devices are provided to exert an axial force that tends to engage, one with the other, said first and second coupling devices, so as to secure said centrifugal unit to first drive unit, and one of said tubes linked to a collector of one of the components coming from the centrifugation process includes a proportional valve and detection devices located upstream of the tube to measure the degree of purity of a component that has to flow through said tube, with the detector being connected to said proportional valve to regulate the flow in said tube on the basis of the degree of purity measured.

22. A device according to claim 21, wherein:

a double prism is installed in said separation chamber, and said detection devices comprise:

a light beam directed in the path of the double prism that is stationary with respect to said centrifugal unit; and a photoelectric detector to measure an angular value of a portion of the double prism emerging from the layer of blood cells in the plasma and to deliver to a control unit of said proportional valve a characteristic signal of such angular value.

23. A centrifugal device for liquids, such as blood, containing suspended particles, comprising:

a first drive unit that is mounted and pivoting;

a second drive unit that is mounted and pivoting coaxially to the first drive unit;

devices to drive said first and said second drive units, with a rotational speed ratio of 2:1 between each other;

a centrifugal unit for said liquid having a center, comprising at least three channels connecting the center to a peripheral separation chamber; and at least three tubes, each presenting a first extremity integral with a central extremity of a channel respectively of said centrifugal unit, with each tube forming an open loop around said centrifugal unit, with a portion of each loop kinematically integral with such second drive unit, with one of said tubes being connected to a supply source of said liquid to be centrifuged with at least one other used to recover a liquid component wherein:

first coupling devices are integral with said first drive unit;

second coupling devices are integral with said centrifugal unit;

elastic devices are provided to exert an axial force that tends to engage, one with the other, said first and second coupling devices, so as to secure said centrifugal unit to first drive unit;

one (1) of said units assembled by said coupling devices includes an axial passage to an internal extremity to which a ball ring is coaxially installed;

the other (2) of said coupling devices comprises a tenon with a diameter that conforms with that of said axial passage and for which the length exceeds that of the passage, with the part of the tenon protruding from said axial passage comprising a ring-shaped groove sized to receive in part the ball ring and adjacent to a truncated extremity of the tenon; and a tubular piston of which one extremity presents a well-formed funnel to receive such ball ring is associated with said elastic devices to press the piston axially in the direction of the extremity of said passage adjacent to said ball ring to apply such ring by exerting on it a centripetal pressure to apply balls in said ring-shaped groove, with a gripping device integral with said tubular piston to permit its displacement against said elastic devices.

24. A centrifugal device for liquids, such as blood, containing suspended particles, comprising:

a first drive unit that is mounted and pivoting;

a second drive unit that is mounted and pivoting coaxially to the first drive unit;

devices to drive said first and said second drive units, with a rotational speed ratio of 2:1 between each other;

a centrifugal unit for said liquid having a center, comprising at least three channels connecting the center to a peripheral separation chamber; and at least three tubes, each presenting a first extremity integral with a central extremity of a channel respectively of said centrifugal unit, with each tube forming an open toot around said centrifugal unit, with a portion of each loop kinematically integral with such second drive unit, with one of said tubes being connected to a supply source of said liquid to be centrifuged with at least one other used to recover a liquid component wherein:

first coupling devices are integral with said first drive unit;

second coupling devices are integral with said centrifugal unit;

elastic devices are provided to exert an axial force that tends to engage, one with the other, said first and second coupling devices, so as to secure said centrifugal unit to first drive unit, and said first and second coupling devices include:

a split ring-shaped elastic component coaxially arranged at an internal extremity of an axial passage of this first drive unit of which the cross-section is smaller than the diameter of this elastic component;

a tubular piston of which one extremity presents a well-formed funnel to receive this component, with said elastic devices pressing axially against this piston in the direction of the internal extremity of said passage to apply the split ring-shaped elastic component by tightening it radially so that its inner diameter is less than that of said passage; and a gripping unit integral with said tubular piston to displace the piston against said elastic devices.

25. A centrifugal device for liquids, such as blood, containing suspended particles, comprising:

a first drive unit that is mounted and pivoting;

a second drive unit that is mounted and pivoting coaxially to the first drive unit;

devices to drive said first and said second drive units, with a rotational sped ratio of 2:1 between each other;

a centrifugal unit for said liquid having a center, comprising at least three channels connecting the center to a peripheral separation chamber; and at least three tubes, each presenting a first extremity integral with a central extremity of a channel respectively of said centrifugal unit, with each tube forming an open loop around said centrifugal unit, with a portion of each loop kinematically integral with such second drive unit, with one of said tubes being connected to a supply source of said liquid to be centrifuged with at least one other used to recover a liquid component wherein:

first coupling devices are integral with said first drive unit;

second coupling devices are integral with said centrifugal unit; elastic devices are provided to exert an axial force that tends to engage, one with the other, said first and second coupling devices, so as to secure said centrifugal unit to first drive unit; and said first and second coupling devices include:

a tenon of which the cross-section complements that of said passage, with the tenon containing a groove located at an outlet of said passage to receive a split ring-shaped component and adjacent to a conical extremity to permit the split ring-shaped component to open during the insertion of the tenon in said axial passage to bring the groove in front of the split ring-shaped component so as to permit engagement and to secure the centrifugal unit to the drive unit; and a gripping unit is integral with said tubular piston to permit displacement of the piston against said elastic devices.

* * * * *

UNITED STATES PATENT AND TRADEMARK OFFICE

CERTIFICATE OF CORRECTION

PATENT NO. : 6,709,377 B1
APPLICATION NO. : 09/958468
DATED : March 23, 2004
INVENTOR(S) : Jean-Denis Rochat It is certified that error appears in the above-identified patent and that said Letters Patent is hereby corrected as shown below:

On title page, item 57 Abstract, Line 15
replace "to the sad elastic devices"
with --to said elastic devices--.

Col. 14, line 23 & 24
replace "with a rotational sped"
with --with a rotational speed--.

Col. 10, line 15
replace "first drive unit and"
with --first drive unit; and--.

Signed and Sealed this

Twenty-ninth Day of May, 2007

JON W. DUDAS
*Director of the United States Patent and Trademark Office*